United States Patent [19]

Burton

[11] 3,970,026

[45] July 20, 1976

[54] PORTABLE TWEEN DECK

[75] Inventor: Grady Burton, Mountain Lakes, N.J.

[73] Assignee: MacGregor-Comarain, Inc., Cranford, N.J.

[22] Filed: May 29, 1975

[21] Appl. No.: 582,035

[52] U.S. Cl. ..... 114/85

[51] Int. Cl.[2] ..... B63B 3/48

[58] Field of Search ..... 114/85, 75, 76, 72, 114/73; 52/263, 669, 36; 211/148; 108/64, 111, 114, 157

[56] References Cited

UNITED STATES PATENTS 3,654,887 4/1972 Iwami ..... 114/72

FOREIGN PATENTS OR APPLICATIONS 947,859 8/1956 Germany ..... 114/76

*Primary Examiner*—George E. A. Halvosa
*Assistant Examiner*—Sherman D. Basinger
*Attorney, Agent, or Firm*—Frank J. Jordan

[57] ABSTRACT

A portable tween deck for a barge or the like includes a plurality of panel assemblies supported between a center support and two end supports. Each panel assembly includes a plurality of spaced pipes which are secured to a plurality of transverse collars. Deck plates are welded to the pipes to bridge the space between the pipes and connecting pins are provided for detachably securing the panel assemblies to each other and to the center support. The portable tween deck may be readily assembled and disassembled within a barge or the like to provide, when desired, a tween deck for carrying automobiles or the like.

6 Claims, 9 Drawing Figures

PORTABLE TWEEN DECK

BACKGROUND OF THE INVENTION

This invention relates to a portable tween deck for watercraft such as barges, ships and the like.

Generally speaking, most existing seagoing vessels are not designed to transport automobiles. However, due to increasing shipments of automobiles by water it has become necessary for shippers to adapt their vessels to carry as much of this type cargo as possible on an intermittent basis only. To accomplish this in larger seagoing vessels, extra or additional decks are sometimes permanently installed in the vessel and arranged to fold or stow in such a manner that, when not carrying automobiles, the originally intended bulk or break bulk cargo may be carried.

The present invention relates to an extra tween deck for barges or the like which accomplishes the result as described above of increasing the automobile carrying capacity on a barge on a temporary basis at minimum expenditure.

Accordingly, an object of the present invention is to provide a portable tween deck for barges and the like which is portable, light in weight and which is capable of rapid assembly and disassembly.

Another object is to provide a portable tween deck which has the capability of being easily and compactly stowed and wherein no permanent fittings or attachment points are required in the vessel on which the portable tween deck is installed.

A further object of the present invention is to provide a portable tween deck which is readily interchangeable between vessels of the same design, which is economical to produce, and which provides for doubling the carrying capacity of a vessel by the addition of one additional deck in the barge.

Other features which are considered characteristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and operation of the invention however, together with additional objects and advantages thereof will be best understood from the following description of specific embodiments when read in connection with the accompanying drawings.

SUMMARY OF THE INVENTION

A portable tween deck for a barge or the like includes a plurality of panel assemblies supported between a center support and two end supports. The panel assemblies each include a plurality of spaced pipes which are secured to a plurality of transverse collars. Longitudinally spaced deck plates bridge the space between the pipes. First connecting means are provided for detachably securing the panel assemblies to the center support and second connecting means are provided for detachably securing adjacent panel assemblies to each other, whereby the portable tween deck may be readily assembled and disassembled within a barge or the like.

DESCRIPTION OF THE PREFERRED EMBODIMENTS

Figure 1:
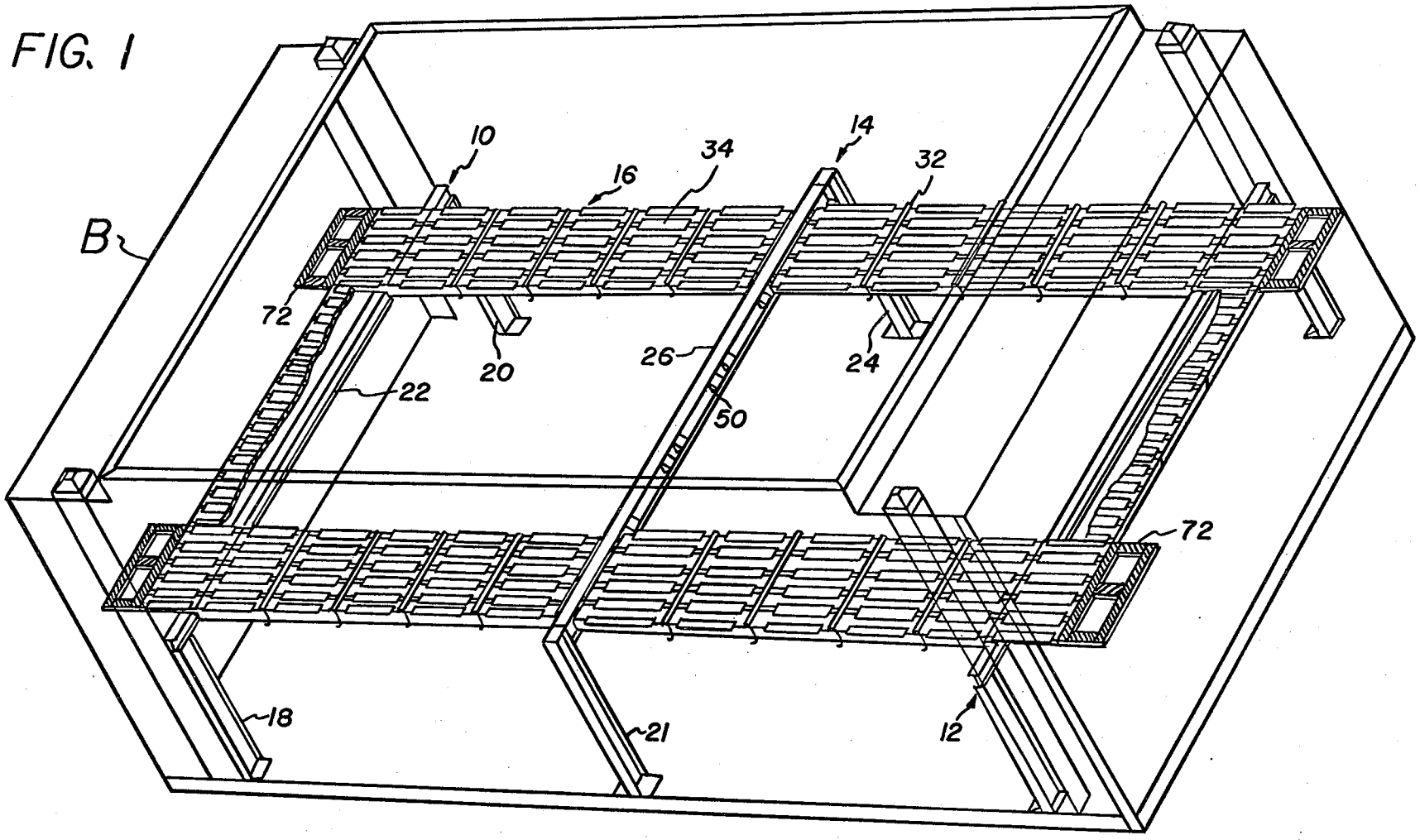
FIG. 1 is a perspective view, partly broken away, of a portable tween deck according to one embodiment of the invention.

Referring to the drawings, FIG. 1 shows a barge B in which the portable tween deck of the present invention is installed. The portable tween deck comprises four basic parts or sections, that is, two end supports 10 and 12, a center support 14, and a plurality of panels or panel assemblies 16. The panel assemblies 16 are supported between the center support 14 and each end support 10, 12 as will be further described in greater detail. The aforementioned four basic parts or sections 10, 12, 14, 16 of the tween deck are adapted to be installed in a barge without requiring any permanent fittings or attachment points to the barge so that the portable tween deck may be rapidly assembled and disassembled as may be required. By installing the portable tween deck of the present invention in a barge, it will be possible to double the automobile carrying capacity of the barge. On the other hand, the portable tween deck may be rapidly disassembled and arranged to be stowed in such a manner that, when not carrying automobiles, the originally intended bulk or break-bulk cargo may be carried.

Turning to the more detailed constructional features, the end supports, for example end support 10, comprise two upright members 18, 20 suitably detachably connected to the barge and a cross beam 22, extending between the upper ends of the uprights 18, 20. Similarly, the center support 14 includes two uprights 21, 24 detachably mounted on the barge and carrying a cross beam 26.

Extending between each end support 10, 12 and the center support 14 are a plurality of panels 16. In the illustrated embodiments, ten panels 16 are employed, that is five panels between the center support 14 and one end support 10 and five panels 16 between the center support 14 and the other end support 12. Although only four panels are shown in FIG. 1, portions of the remaining eight panels are shown at the longitudinal ends of the barge and it will be understood that the ten panels when assembled define a deck on which the automobiles may be carried.

Figure 2:
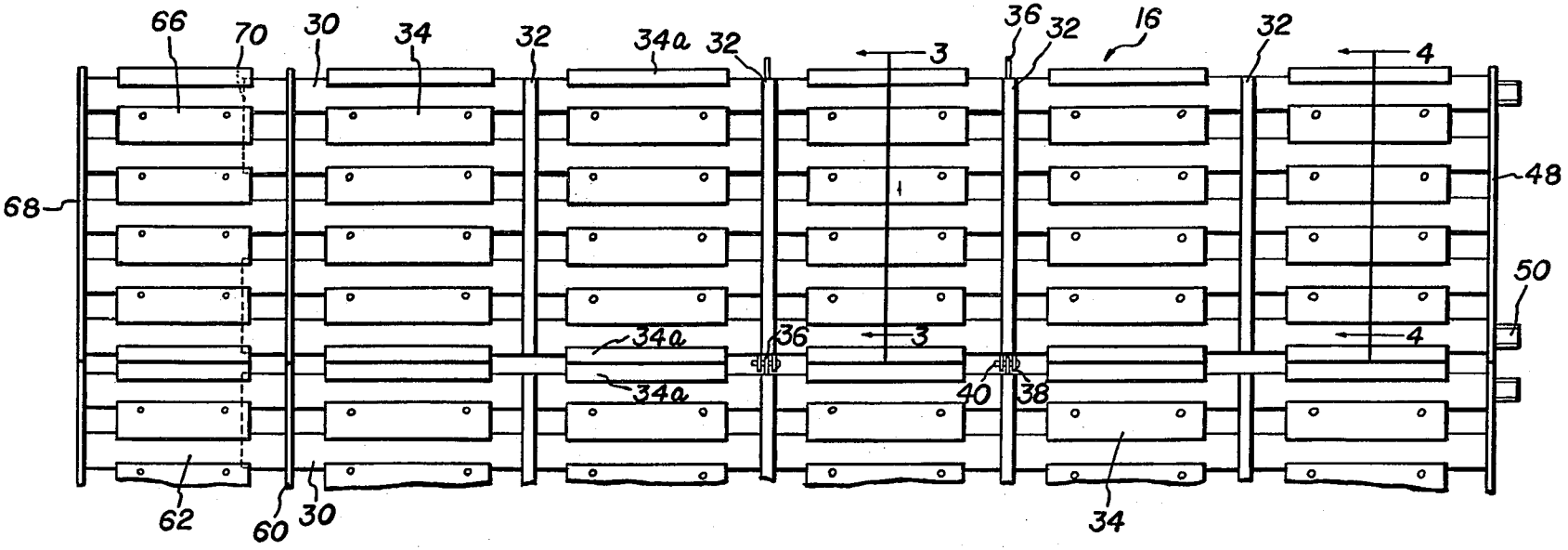
FIG. 2 is a partial plan view of the portable tween deck shown in FIG. 1.

FIG. 2 is a plan view of one complete panel 16 and a partial view of an adjoining panel. It will be seen that each panel 16 comprises a plurality of pipes 30 having a generally rectangular cross sectional configuration. In the illustrated embodiment, each panel 16 includes five elongated pipes 30 although any other number may be used as desired. The pipes 30 are arranged in spaced relationship to one another and are joined by transverse collars 32 which have a C-shaped cross-sectional configuration. The tubes 30 pass through spaced openings in the C-shaped collars 32 and each tube 30 is welded to the C-shaped collars. As can be seen in FIG. 2 a plurality of these C-shaped collars are arranged in spaced relationship to one another. Accordingly, it will be seen that the arrangement of the C-shaped collars 32 and the pipes 30 provide a permanent unit construction which defines the basic structure of the panel.

A plurality of deck plates 34 are welded to the pipes 30 in a manner such that the deck plates 34 bridge the gap or spacing between the pipes 30 as best can be seen in FIG. 2. The sides of each panel 16 may have narrower deck plates 34*a* welded to the outer pipe 30 so that when two panels 16 are joined to one another as will be explained hereinafter, the narrower deck plates 34*a* will mate with an adjoining narrower deck plate 34*a* of the adjoining panel to thereby form and define a deck plate having a width comparable to the width of the deck plate 34.

Figure 8:
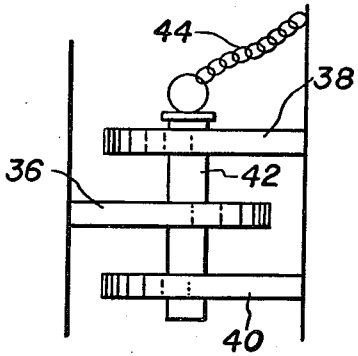
FIG. 8 is a partial plan view showing the toggle pin used for detachably connecting the panels.

In order to secure the sides of the panels 16 to one another, suitable lugs 36 are welded to the sides of the panel, for example to the sides of the outermost pipe 30. Thus, two lugs 38, 40 (FIG. 8) may extend from one panel 16 and another lug 36 from the other juxtaposed panel 16, whereby aligned openings in the lugs 36, 38, 40 are adapted to receive a toggle pin 42 to thereby detachably secure the two panels together. A chain or other flexible connector 44 may be provided to prevent loss of the toggle pin 42 when the units are disassembled.

Figure 5:
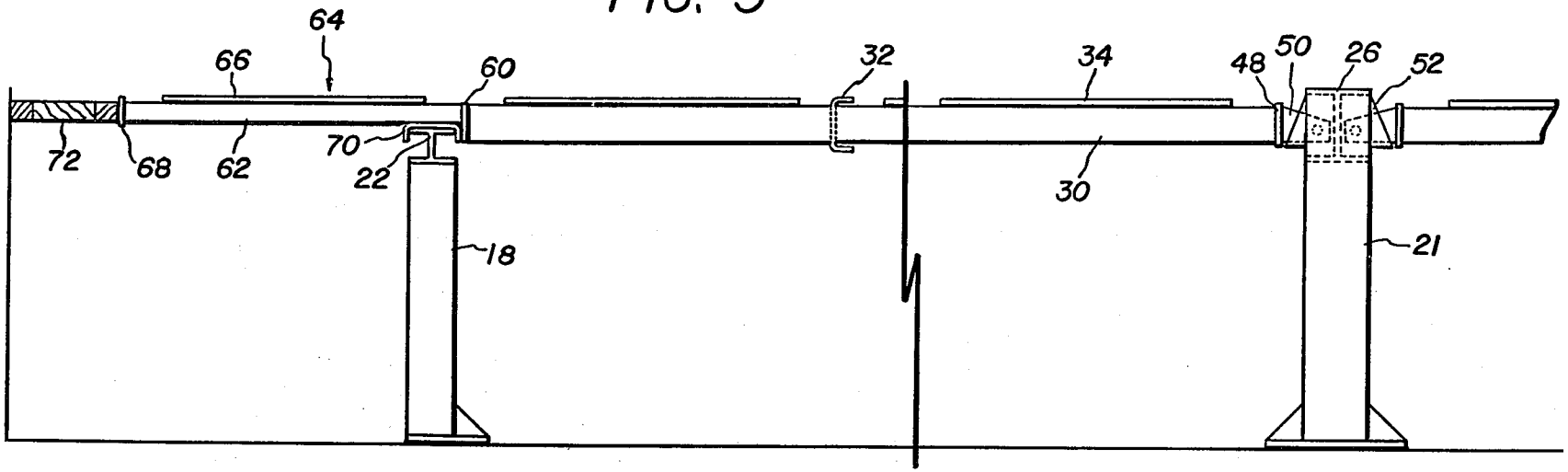
FIG. 5 is an elevational view, partially broken away, of a portion of the tween deck installed within a vessel.
Figure 7:
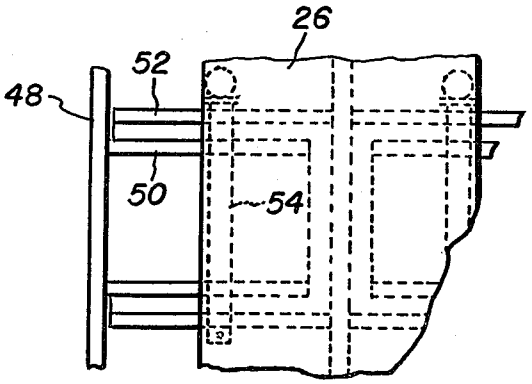
FIG. 7 is a partial plan view of FIG. 6.
Figure 6:
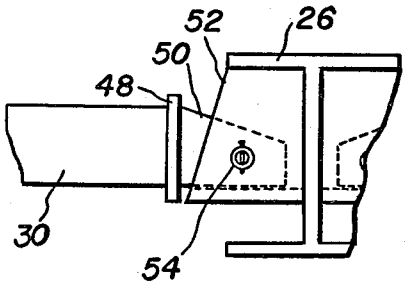
FIG. 6 is partial elevational view showing the detachable connection of the panel to the center support.

Referring now to FIGS. 5 and 6, it will be seen that a plate 48 is welded to the ends of the pipes 30 and to this plate 48 a plurality of lugs 50 are welded. These lugs 50 are adapted to be located adjacent to suitable lugs 52 provided on the cross beam 26 of the central support 14 so that a suitable toggle pin 54 may pass through aligned openings on the lugs 50, 52 to provide a detachable connection between the panels 16 and the central support 14. As shown in FIG. 7, double lugs may be provided to effect the connection and the support.

Referring to FIG. 5, it will be seen that the other longitudinal ends of the pipes 30 also have a plate 60 welded to the longitudinal ends thereof. Extending from this plate 60 are a plurality of smaller or secondary pipes 62 which are generally longitudinally aligned with the main pipes 30. As will be further described, these smaller pipes 62 form a cantilever platform 64 extending beyond the end supports 10, 12 to provide additional deck space for carrying automobiles. The smaller pipes 62 are spaced from one another with the same spacing as the main pipes 30 and also include deck plates 66 bridging the gaps between the pipes 62, such deck plates 66 being arranged similarly to the deck plates 34 previously described. A suitable transverse plate 68 may be welded to the ends of the pipes 62. As can be seen in FIG. 5, one or more generally inverted U-shaped cross beams 70 are welded to the underside of the pipes 62 adjacent to the plate 60 and these inverted U-shaped cross beams 70 are adapted to fit over the cross beams 22 of the end supports 10, 12.

As can be seen in FIG. 1, end bumpers 72 constructed of wood or the like are fitted at each longitudinal end of the barge and are disposed between the barge and the plate 68 at the longitudinal end of the pipes 62 to thereby prevent longitudinal shifting of the tween deck within the barge.

Adjusting screws may also be provided along the outer edges of the tween deck to prevent lateral shift of the tween deck within the barge and may be installed near the top of the leg of each support. In this regard, it is pointed out that although a particular type of barge may have the same general dimensions, each barge may vary in tolerance so that such adjusting screws would serve to provide for the tolerance and variation in dimensions between the sizes of the various barges. Although not shown, personnel guard rails may be installed at the periphery of the deck assembly.

Each end support 10, 12 and the center support 14 may be composed of two legs and one cross beam which is bolted to the two respective legs. The pipes 30, 62, collars 32, plates 34, 34*a*, plates 48, 68, lugs 36–40, 50, 52 are suitably welded in the positions shown in the drawings.

Figure 9:
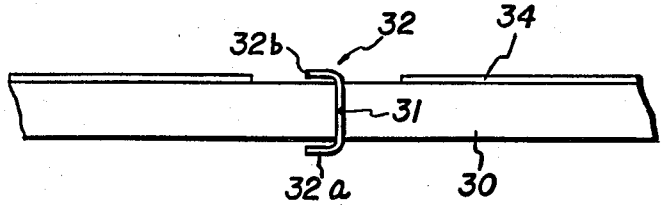
FIG. 9 is a partial elevational view of the panel showing the collar to which the pipes are secured.
Figure 3:
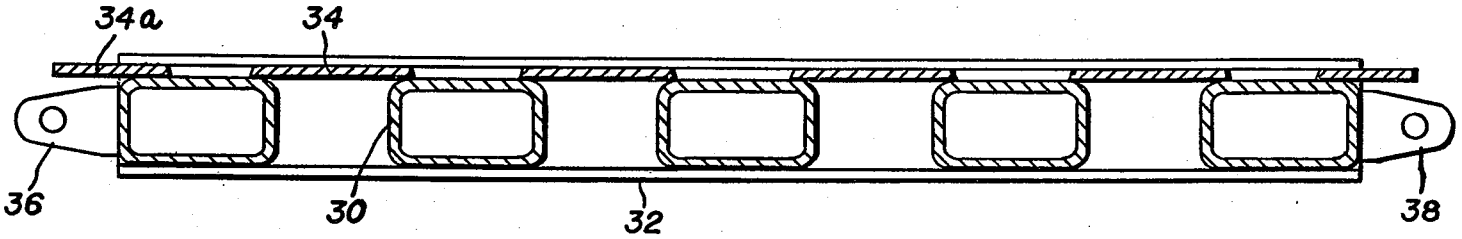
FIG. 3 is a sectional view taken along the line 3—3 in FIG. 2.
Figure 4:
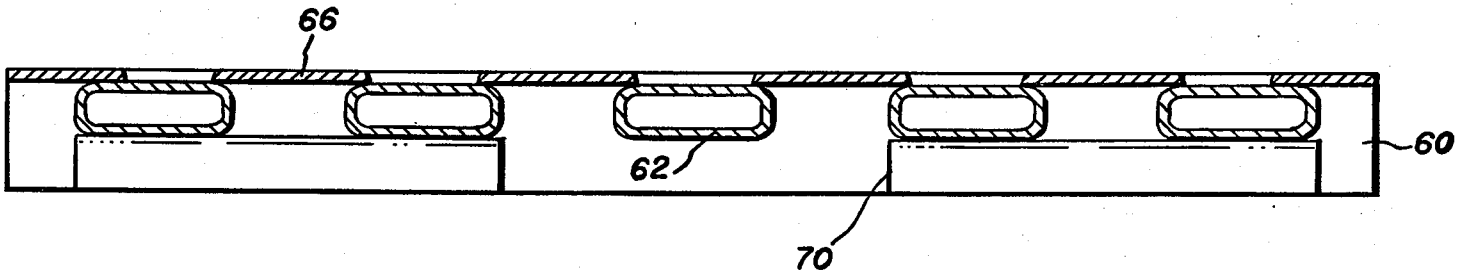
FIG. 4 is a sectional view taken along the line 4—4 in FIG. 2.

The C-shaped collar 32 previously described may be initially formed in two halves 32*a*, 32*b* (FIG. 9) each having an L-shaped configuration. Each L-shaped half 32*a*, 32*b* may have generally U-shaped cutouts adapted to receive approximately one half of the pipes 30. Accordingly, the pipes 30 may first be placed into the cutouts of the L-shaped halves 32*a* and then the other L-shaped half 32*b* mated therewith to form the C-shaped collar 32 whereupon the two halves 32*a*, 32*b* are welded together at 31 to form the C-shaped collar 32 and the pipes 30 are welded to this C-shaped collar 32.

From the above description it will be seen that there has been described a portable tween deck which is capable of rapid assembly and disassembly, which may be assembled within a barge without requiring permanent fittings or attachment points in the barge, which may be economically produced, and which is capable of providing an additional deck to thereby double the carrying capacity for automobiles for the barge. The tween deck assembly is readily interchangeable between the barges of the same size and is capable of being easily and compactly stowed when not in use.

It is thought that the invention and many of its attendant advantages will be understood from the foregoing description and that it will be apparent that various changes may be made in the form, construction, and arrangements of the parts without department from the spirit and scope of the invention or sacrificing all ot its material advantages. The form heretofore described being merely a preferred embodiment thereof.

What is claimed is:

1. A portable tween deck for watercraft comprising a center support means and two end support means, panel assemblies supported between said center support means and said end support means, said panel assemblies each comprising a plurality of spaced pipes, transverse collars secured to said spaced pipes, said collars have a generally C-shaped cross sectional configuration having a central web and two depending flange portions, said central web having a plurality of spaced openings with each opening having a configuration corresponding to the cross sectional configuration of said pipes, said pipes being accommodated within said openings, longitudinally spaced deck plates bridging the space between said pipes, first connecting means for detachably securing said panel assemblies to said center support means, and second connecting means for detachably securing adjacent panel assemblies to each other.

2. A portable tween deck according to claim 1 wherein said generally C-shaped collars are initially formed as two generally L-shaped members each having spaced generally U-shaped cutouts corresponding to approximately one-half the configuration of said pipes, said pipes being placed in the cutouts of one L-shaped member followed by positioning and welding of the other L-shaped member onto said one L-shaped member.

3. A portable tween deck according to claim 1 wherein said pipes have a generally rectangular cross sectional configuration, wherein the wider sides of said generally rectangular pipes are horizontally disposed, said deck plates being welded to said wider sides, said deck plates being transversely spaced from one another such that portions of said wider side of said pipes form a part of the upper deck surface.

4. A portable tween deck for watercraft comprising a center support means and two end support means, each of said end support means and said center support means comprising a pair of upright members and a cross beam connected to the upper end portion of said upright members, panel assemblies supported between said center support means and said end support means, said panel assemblies each comprising a plurality of spaced pipes, transverse collars secured to said spaced pipes, longitudinally spaced deck plates bridging the space between said pipes, first connecting means for detachably securing said panel assemblies to said center support means, and second connecting means for detachably securing adjacent panel assemblies to each other; said first connecting means comprising at least one flange on said cross beam of said center support means and at least one flange on the longitudinal end of said panel assembly, said flanges having aligned openings, said first detachable means further comprising toggle bolts in said aligned openings.

5. A portable tween deck for watercraft comprising a center support means and two end support means, panel assemblies supported between said center support means and said end support means, said panel assemblies each comprising a plurality of spaced pipes, transverse collars secured to said spaced pipes, longitudinally spaced deck plates bridging the space between said pipes, first connecting means for detachably securing said panel assemblies to said center support means, second connecting means for detachably securing adjacent panel assemblies to each other, each of said panel assemblies comprising engaging members secured to the underside thereof, said engaging members resting on said end support means, and secondary pipes extending longitudinally beyond said engaging members to thereby define a cantilever panel section on said panel assembly, and means between the longitudinal end of said cantilever panel section and said watercraft to prevent longitudinal shifting of said panel assemblies in said watercraft.

6. A portable tween deck according to claim 5 wherein said secondary pipes have a generally rectangular cross-sectional configuration, said secondary pipes having smaller cross-sectional dimension than the first said pipes.

* * * * *